US005580064A

United States Patent [19]

Childers, Jr.

[11] Patent Number: 5,580,064

[45] Date of Patent: Dec. 3, 1996

[54] PORTABLE GOAL APPARATUS

[76] Inventor: Robert L. Childers, Jr., 4584 Hillview Shores, Clarkston, Mich. 48348

[21] Appl. No.: 265,277

[22] Filed: Jun. 24, 1994

[51] Int. Cl.[6] ..... A63B 63/00

[52] U.S. Cl. ..... 273/400

[58] Field of Search ..... 273/127 B, 410, 273/411, 26 R, 26 A

[56] References Cited

U.S. PATENT DOCUMENTS

| | | | |
|---|---|---|---|
| 3,226,118 | 4/1963 | Nehl . | |
| 4,083,561 | 4/1978 | Daffer | 273/411 |
| 4,083,562 | 4/1978 | Zepper | 273/127 B |
| 4,127,272 | 11/1978 | Pennell . | |
| 4,258,923 | 3/1981 | Senoh . | |
| 4,407,507 | 10/1983 | Caruso et al. . | |
| 4,420,158 | 12/1983 | Klock | 273/127 B |
| 4,702,478 | 10/1987 | Kruse | 273/127 B |
| 4,786,053 | 11/1988 | Barnes, Jr. . | |
| 4,842,283 | 6/1989 | LeBel | 273/26 A |
| 4,948,149 | 8/1990 | Lin et al. . | |
| 5,002,274 | 3/1991 | Bidema | 273/410 |
| 5,048,844 | 9/1991 | Haseltine | 273/26 A |
| 5,080,375 | 1/1992 | Moosavi | 273/411 |
| 5,308,083 | 5/1994 | Grunfeld et al. . | |
| 5,316,314 | 5/1994 | Wilson . | |

FOREIGN PATENT DOCUMENTS

| | | |
|---|---|---|
| 0176317 | 9/1985 | European Pat. Off. . |
| 2551982 | 9/1983 | France . |
| 2636659 | 9/1988 | France . |
| 1910844 | 9/1970 | Germany . |

*Primary Examiner*—Theatrice Brown

*Attorney, Agent, or Firm*—Harness, Dickey & Pierce, P.L.C.

[57] ABSTRACT

A portable goal apparatus which is lightweight, portable, and disassembles into a compact package. The goal pieces interconnect using convenient snap fittings. The goal apparatus includes elbows which facilitate assembly through ease of insertion and snap connections which may be easily disengaged. Further, the assembled goal has sectional horizontal and vertical supports comprised of sections which interconnect to form a substantially rigid structure.

13 Claims, 2 Drawing Sheets

PORTABLE GOAL APPARATUS

BACKGROUND

1. Technical Field

This invention relates to a portable sports goal. More particularly, this invention relates to a portable soccer goal which may easily be assembled and disassembled, yet still provides a relative sturdy goal structure.

2. Discussion

Soccer has long enjoyed substantial popularity throughout the world and, with the possible exception of the United States, is one of the most popular team sport worldwide today. In the United States, while soccer has traditionally attracted less attention than other team sports such as baseball, football, and basketball, soccer appears to be steadily increasing in popularity amongst the grade schools and high schools throughout the United States. Many children age ten and under participate in a number of soccer leagues, reflecting an increasing popularity amongst the younger age groups. One reason for soccer's popularity may stem from the relatively inexpensive start-up costs to participate on a team. With respect to equipment, soccer merely requires a sufficiently sized field with the appropriately chalked out-of-bounds designations, a ball, and a pair of goals. Soccer thus does not require typically costly indoor facilities or an extraordinary amount of equipment in order to participate.

Previously, soccer fields dimensions were normally fixed with a pair of goals constructed from heavy steel pipes which formed vertical and horizontal sections joined accordingly by elbows fixed at the ends of the fields. These heavy, relatively immovable structures were fixed on the field so that lines need only be chalked and nets affixed to the goal structures in order to conform the field to regulations. The framed structures, while being immovable and sturdy so that they did not collapse when players collided with them, were not sufficiently portable so that they could be transported to other fields. Thus, only a limited number of soccer fields could be erected due to space requirements, as other fields (e.g., football fields) were not easily adapted for soccer play. This resulted in a need for portable soccer goals which could be assembled and disassembled, through some effort, so that games could be held at a variety of fields and so that American football fields could be adapted to the game of soccer. Unfortunately, these portable goals required considerable time and effort to assemble, disassemble, and may be particularly cumbersome to transport as they may be heavy. Further, many such goals required a number of small, easily misplaced fasteners which may be easily lost further inhibiting assembly.

Further, the portable soccer goals available today generally have upper horizontal cross members which typically droop when assembled to a full-sized soccer goal. Because of the width of the soccer goal, it is difficult to support the horizontal cross member and to provide a substantially horizontal cross member which does not droop due to the combined weight of the cross bar itself and the net which it supports. Furthermore, when a typical portable soccer goal is disassembled, the overall length of the disassembled soccer goal exceeds the maximum width of a typical vehicle trunk, requiring transportation on the vehicle roof and making it difficult to conveniently transport the portable soccer goal.

More generally, in addition to the above-discussed aspects of portable soccer goals, other commonly available goal structures (e.g., hockey, lacrosse, and the like) are often difficult and time consuming to assemble as well. Typically, the goal structures include members which are glued or, for more portable goals, remain erect through press fitted engagement. Goals assembled using press fitted engagement often are difficult to disassemble because mated parts resist separation due to frictional forces between them. Hence, disassembly often requires jarring with heavy tools, such as a hammer, resulting in damage to the goal. Where elongate members meet at joints or elbows, the above-mentioned deficiencies manifest themselves in particular.

Therefore, it is desirable to provide a soccer goal which may be easily assembled and disassembled into a suitably portable size and which has a horizontal cross bar that maintains a substantially horizontal alignment.

SUMMARY OF THE INVENTION

In accordance with the teachings of the present invention this invention is directed to a portable soccer goal including a frame having elongate members coupled to form the frame and resting generally erect with a front portion and a rear portion projecting therefrom. The front portion of the goal defines a generally rectangular opening. A net covers the rearwardly extending portion of the frame. Further, the elongate members may be non-axially coupled via a plurality of couplings engageably receiving the elongate members to define a locking coupling. The elongate members are insertably received by the couplings and have a member which is recessed during insertion and which protrudingly engages a bore in the coupling upon a predetermined insertion length and orientation to effect assembly of the portable goal structure. The recessable member may also recessed to disengage the aperture to effect disassembly of the portable goal structure.

The various advantages of the present invention will become apparent to one skilled in the art by reading the following specification and by reference to the following drawing in which:

DETAILED DESCRIPTION OF THE DRAWINGS

Figure 1:
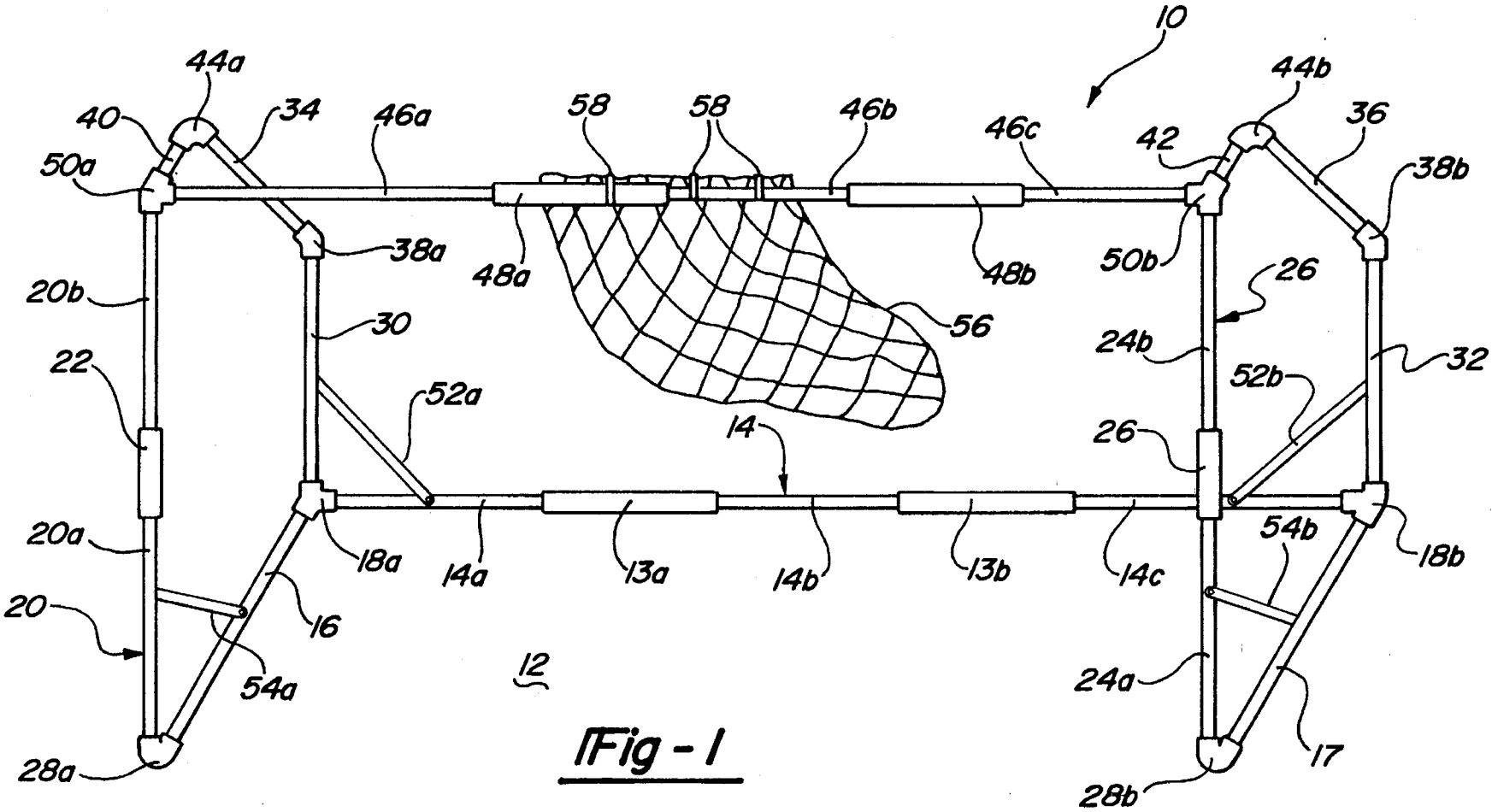
FIG. 1 depicts a portable soccer goal arranged according to the principals of this invention.

FIG. 1 depicts a portable sports goal 10 arranged in accordance with the principals of this invention. The goal 10 is typically assembled and staked to the ground 12 in a predetermined position in accordance with the particular dimensions specified by the contest requiring the goal. Portable soccer goal 10 includes lower horizontal crossbar 14 having sections 14*a*, 14*b*, and 14*c* and sidebars 16 and 17. Lower horizontal crossbar sections 14*a* and 14*b* are joined via sleeve interconnection 13*a*. Lower horizontal crossbar sections 14*b* and 14*c* are joined via sleeve interconnect 13*b*. Lower horizontal crossbar section 14*a* and lower sidebar 16 are joined at tri-connect elbow 18*a* at approximately a 90 degree angle. Likewise, lower horizontal crossbar section 14*c* and lower 17 are joined at tri-connect elbow 18*b* approximately a 90 degree. At the front of goal 10 vertical post sections 20*a* and 20*b* interconnect at sleeve interconnection 22 to form left front post 20. Similarly, right front vertical post sections 24*a* and 24*b* interconnect at sleeve 26 to form right front vertical post 24. Lower sidebar 16 interconnects to left front post 20 (via left front post section 20*a*) at an approximately 90 degree angle via elbow 28*a*. Likewise, lower sidebar 17 connects to right front post 24 (via right vertical post section 24*a*) at an approximately 90 degree angle via elbow interconnect 28*b*. Rear vertical post 30 interconnects to both lower sidebar 16 and lower horizontal crossbar section 14*a* of lower horizontal crossbar 14 via tri-connect elbow 18*a*. Similarly, rear vertical post 32 interconnects with both lower sidebar 17 and lower horizontal crossbar section 14*c* of lower horizontal crossbar 14 via tri-connect 18*b*. Left diagonal member 34 interconnects to rear vertical post 30 via elbow 38*a*. Similarly, right diagonal member 36 interconnects with rear vertical post 32 via elbow interconnect 38*b*. Upper sidebar 40 interconnects with left diagonal member 34 via elbow interconnect 44*a*. Similarly, sidebar. 42 connects to right diagonal member 36 via interconnect 44*b*. Upper horizontal crossbar 46 has sections 46*a*, 46*b*, and 46*c* which connect via connecting sleeves 48*a* and 48*b*. At the left end of upper horizontal crossbar 46, upper horizontal crossbar section 46*a* connects to left vertical post section 20*b* of front vertical post 20 and upper sidebar 40 via tri-connect elbow 50*a*. Similarly, horizontal crossbar section 46*c* of horizontal crossbar 46 interconnects to front vertical post section 24*b* of vertical post 24 and upper sidebar 42 via tri-connect 50*b*.

The sports goal 10 is supported against forces applied in a horizontal direction by support brace 52*a* which diagonally spans rear vertical post 30 (attached behind rear vertical post 30) and lower horizontal crossbar section 14*a* (attached in the front) of lower horizontal crossbar 14 and by support brace 52*b* which diagonally spans rear vertical post 32 (attached in the rear of vertical post 32) and lower horizontal crossbar section 14*c* (attached in the front) of lower horizontal crossbar 14. Sports goal 10 is further supported in a depthwise direction by support brace 54*a* which diagonally spans front vertical post 20*a* (attached on the outside of sports goal 10) and lower sidebar 16 (attached on the inside). Similarly, support brace 54*b* further provides bracing for sports goal 10 and diagonally spans front vertical post section 22*a* (attached on the outside of sports goal 10) and lower sidebar 17 (attached on the inside). Support braces 52*a–b* and 54*a–b* may include a curve to facilitate the above described inside/outside interconnection or, alternatively, may be substantially straight. Further, the inside/outside connection provides an aligning force to maintain the sports goal is suitably erect. Support braces 52*a–b* and 54*a–b* typically interconnect at the respective ends via a clevis pin (not shown) which passes through the support brace and the respective member of sports goal 10 to which it connects and is secured therein by a click pin (not shown). Over the sports goal 10 is draped a net 56 which is secured thereto by fastening bands 58.

Figure 2:
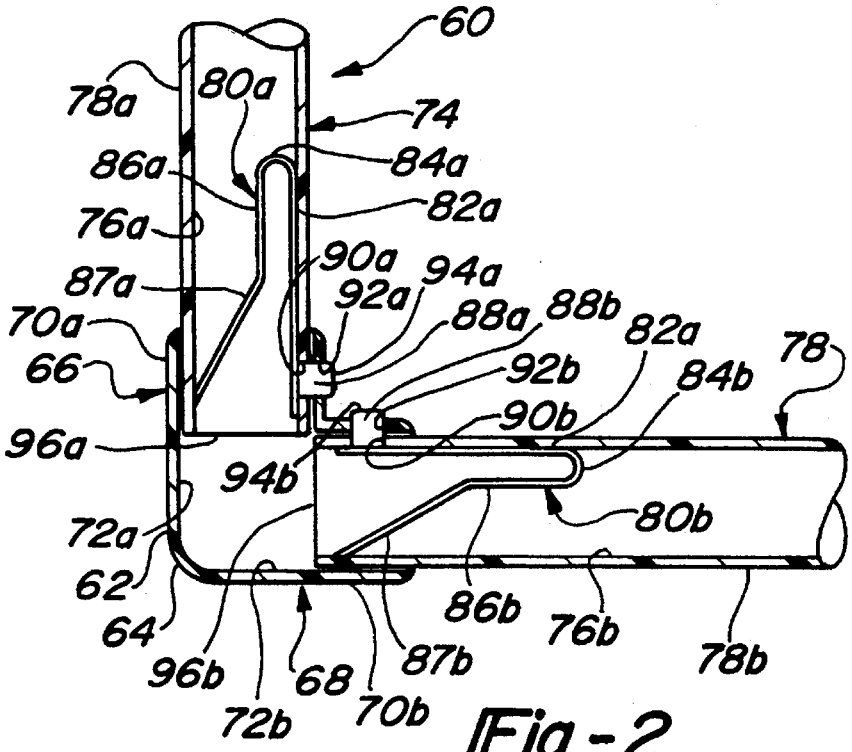
FIG. 2 depicts a cross-sectional view of an interconnection between tubular members of FIG. 1 at an elbow joint; and and FIG. 3 depicts a cross-sectional interconnection between tubular members of FIG. 1 at a sleeve joint.

Referring to FIG. 2, a cross-sectional view of a typical interconnect such as 18*a–b*, 28*a–b*, 38*a–b*, 44*a–b*, and 50*a–b* is shown and is depicted as interconnect 60. Note that interconnect 60 shown in FIG. 2 appears as a two-way interconnect, as compared to a three-way interconnect (such as 15*a–b* or 18*a–b*), but is typical of a cross-sectional view of an angular interconnection (other than 0 degrees or 180 degrees) of either two or three posts, sidebars or crossbars. Interconnect 60 includes an elbow joint 62 having a radius 64 to form an angle between at least a first tubular section 66 and a second tubular section 68. It will be understood that radius 64 is designed to provide a predetermined angle between tubular sections 66 and 68. Each tubular section 66 and 68 includes an outer surface 70*a* and 70*b*, respectively, and an inner surface 72*a* and 72*b*. First and second tubular sections 66 and 68 receive elongated tubular members 74 and 78, respectively, which correspond to any of the interconnecting posts, sidebars, crossbars, or sections thereof described with respect to FIG. 1. Elongated tubular member 74 includes an inner surface 76*a* and an outer surface 78*a* and is sized to fit so that outer surface 78*a* of elongated member 74 and inner surface 72*a* of tubular section 66 provide a partially interfering fit so that insertion of elongated member 74 into tubular section 66 may be accomplished relatively easily, but yet provides a rigid connection. Similarly, elongated member 78 includes an inner surface 76*b* and an outer surface 78*b* sized so that insertion of elongated member 78 with tubular section 68 provides a partially interfering fit so that the interconnection is rigid, but not exceedingly difficult to effectuate.

Elongated members 74 and 78 also include retainer springs 80*a* and 80*b*, respectively, seated against inner surfaces 76*a* and 76*b*, respectively. Retainer springs 80*a* and 80*b* include elongated sections 82*a* and 82*b* and radii 84*a* and 84*b* which curve into shortened sections 86*a* and 86*b* and are then deflected into dog-leg sections 87*a* and 87*b*. Retainer springs 80*a* and 80*b* are formed using a substantially rigid material, and may be deflected about radii 84*a* and 84*b*, respectively, so that spring retainers 80*a* and 80*b* may be compressed and inserted within the inner surfaces 76*a* and 76*b* of elongated members 74 and 78, respectively. Pushbuttons 88*a* and 88*b* protrude from and are in mechanical communication with elongated surfaces 82*a* and 82*b*, respectively. Pushbutton 88*a* protrudes through a hole 90*a* formed in elongated member 74 and through a hole 92*a* formed in tubular section 66. Similarly, pushbutton 88*b* protrudes through a hole 90*b* and elongated member 78 and through a hole 92*b* in tubular section 68. By projecting through holes 90–92*a* and 90–92*b*, pushbuttons 88*a* and 88*b*, respectively, provide secure engagement between elongated member 74 and tubular section 66 and between elongated member 78 and tubular section 68. Further, such engagement provides a locking mechanism by which elongated members 74 and 78 positively engage tubular sections 66 and 68, respectively, until disengagement by pressing pushbuttons 88*a* and 88*b* radially inwardly to compress spring retainers 80*a* and 80*b* so that the top sections 94*a* and 94*b* clear the respective inner surfaces 72*a* and 74*b* of interconnect tubular sections 66 and 68, respectively. Thus, elongated tubular sections 74 and 78 may be positively engaged and disengaged from interconnect 62.

With respect to retainer springs 80*a–b*, pushbuttons 88*a–b* project through holes 90*a–b* with a force that varies in accordance with the dimensions of radii 84*a–b*, respectively. A larger radius induces more separation between elongated section 82*a* and dog leg 89*a* when retainer spring 80*a* is in an uncompressed (not inserted within elongated member 74) state. When retainer spring 80*a* is inserted into opening 96*a* of elongated member 74, the retainer spring 80*a* is biased into a precompressed state so that when positioned within inner surface 76*a* of elongated member 74, retainer spring 80*a* provides an outward force. Retainer spring 80*a* is further positioned so that pushbutton 88*a* protrudes through hole 90*a* of elongated member 74. The aforementioned description of retainer spring 84*b* applies equally to retainer spring 84*b* with respect to elongated member 78.

Figure 3:
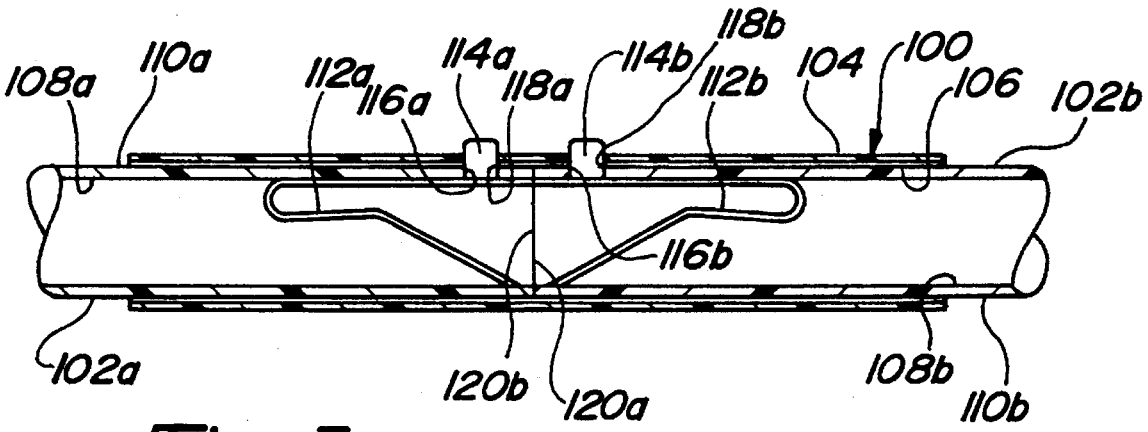

Referring to FIG. 3, an exemplary sleeve section 100 depicts a typical interconnection between any two sections substantially, axially aligned, such as lower horizontal crossbar sections 14*a–c*, upper horizontal crossbar sections 48*a–c*, and vertical post sections 20*a–b* or 24*a–b*. Sleeve member 100 is a substantially tubular member having an outer surface 104 and an inner surface 106. Elongated members 102*a* and 102*b* are tubular structures having inner surfaces 108*a–b* and outer surfaces 110*a–b*, respectively. Outer surface 104 and inner surface 106 of sleeve section 100 may be a substantially the same dimensions as outer surfaces 70*a–b* and inner surfaces 72*a–b* of tubular sections 66 and 68, respectively, of FIG. 1. Similarly, inner surfaces 108*a–b* and outer surfaces 110*a–b* of elongated sections 102*a* and 102*b*, respectively, may be of substantially the same dimensions as inner surfaces 76*a–b* and outer surfaces 78*a–b* of elongated members 74 and 78, respectively. Spring retainers 112*a* and 112b of elongated members 102*a* and 102*b*, respectively, are as described above with respect to FIG. 2 and are arranged so that pushbuttons 114*a–b* project through holes 116*a–b* of elongated tubular members 102*a–b*, respectively, and holes 118*a–b* of sleeve member 100. Holes 118*a–b* provided in sleeve member 100 are arranged so that the ends 120*a–b* of elongated members 102*a–b*, respectively, substantially abut when pushbuttons 114*a–b* engage holes 118*a–b*, respectively. Such abutment in combination with a partial interference fit between inner surface 106 of sleeve member 100 and outer surfaces 110*a–b* of elongated members 102*a–b*, respectively, provides a substantially rigid interconnection so that elongated members 102*a* and 102*b* remain substantially aligned. This enables posts and crossbars formed by the interconnection of a plurality of sections to remain substantially straight and rigid. In particular, with respect to horizontal crossbar 46, such abutment minimizes any droop or sag which may otherwise occur.

In a preferred embodiment, the sports goal 10 facilitates assembly and disassembly and disassembles into a lightweight, substantially easily portable package. Thus, the materials must be substantially lightweight yet rigid in order to maximize portability of the disassembled goal and stability of the assembled goal. To these ends, preferably, portable goal 10 disassembles so that the longest individual part does not exceed seventy inches and the total package does not exceed fifty pounds. For example, for a goal which is 12'W×7'H×8'D, the portable goal 10 disassembles into a package weighing fifty pounds and having a maximum length of seventy inches. In order to effectuate such portability and rigidity, all above crossbars and posts are preferably formed of polyvinylchloride (PVC) or, alternatively, a similarly lightweight yet rigid material such as aluminum, titanium, etc. Further, the sleeved members 13*a–b*, 22, 26, and 48*a–b* are formed of aluminum to provide substantially greater rigidity and lightweight, but may also be of PVC, titanium, etc. Further, support braces 52 and 54 are preferably formed of aluminum or PVC.

Thus, from the above, it can be seen that portable goal 10 provides an easily assembled and disassembled sports goal which is both lightweight and portable as well. More particularly, the elbow interconnections provide relatively quick assembly and disassembly by inserting an elongated tubular member into a tubular section with a slight interference fit to provide stability, but not requiring a substantially frictional interconnection which hinders disassembly. Further, the sleeved interconnections described herein maintain substantial axial alignment between interconnecting sections minimizing droop or sag in axially aligned structures and providing substantial stability in vertically aligned structures.

While the above detailed description describes the preferred embodiment of the present invention, it will be understood that the present invention is susceptible to modification, variation and alteration without deviating from the scope and fair meaning of the subjoined claims.

What is claimed is:

1. A portable goal comprising:

a frame defined by a plurality of axially and non-axially aligned elongated tubular members, said frame having front and rear portions and a pair of opposite side portions, said front portion defining a generally rectangular shaped opening;

attachment means for releasably locking said tabular members in an end-to-end relationship to thereby form said frame;

said attachment means comprising first and second components, said first component comprising an aperture adjacent each end of said elongated tubular members and a spring-biased protrusion extending outwardly through said aperture, and said second component being a tubular member having an internal dimension slightly larger than the external dimension of said elongated tubular members and having first and second ends and an aperture adjacent said first and second ends thereof, whereby when an end of an elongated tubular member is inserted into an end of said second component, and spring-biased protrusion will extend through aligned apertures of said elongated tubular member and said second component;

said front portion of said frame being defined by a pair of spaced apart substantially vertical tubular members and a horizontal tubular member having its ends attached to the upper end of said vertical tubular members;

said rear portion of said frame being defined by a pair of spaced apart substantially vertical tubular members and a horizontal tubular member having its ends attached to the lower end of said rear portion vertical tubular members;

each of said side portions of said frame being defined by a lower horizontal tubular member having one end attached to the lower end of one of said front portion vertical tubular member and its other end attached to the lower end of a said rear portion vertical tubular member;

said side portions being further defined by an upper tubular member having first and second sections, said first section extending diagonally upward from the upper end of said front portion vertical tubular member and having one end attached thereto, and said second section having one end attached to the other end of said first section and extending diagonally downward to the upper end of a said rear portion vertical tubular member and attached thereto; and a net means covering said rear and side portions of said frame.

2. The apparatus as defined in claim 1 further wherein said apertures are spaced so that when said first and second section engages said second component said first and second section substantially abut.

3. A portable goal as defined in claim 1 wherein, said attachment means is comprised of a plurality of two-way and three-way connectors.

4. A portable goal comprising:

a pair of substantially parallel front posts defining a left front post and a right front post, said front posts having a plurality of sections joined by a sleeve member;

a pair of substantially parallel back posts defining a left back post and a right back post, said left front post and said left back post being joined at first ends by a left lower sidebar, and said right front post and said right back post being joined at first ends by a right lower sidebar;

a pair of substantially parallel diagonal member defining a left diagonal member and a right diagonal member, a first end of said left diagonal member being coupled to a second end of said left back post and a first end of said right diagonal member being coupled to said a second end of said right back post;

a pair of upper sidebars defining a left upper sidebar and a right upper sidebar, said left upper sidebar coupled at a first end to a second end of said left diagonal member, and said right upper sidebar coupled at a first end to a second end of said right diagonal member;

a pair of substantially parallel horizontal crossbars having a plurality of sections, each of said sections substantially aligned and joined by a sleeve member, and defining upper and lower horizontal crossbars, said lower horizontal crossbar joined at a first end to said left lower sidebar and the first end of said left back post and joined at a second end to said right lower sidebar and the first end of said right back post, said upper horizontal crossbar joined at a first end to a second end said left upper sidebar and a second end of said left front post and at a second end to a second end of said right upper sidebar and a second end of said right front post; and a plurality of connectors for joining one of said crossbars, sidebars, members, and posts to another of said crossbar, sidebars, members, and posts, said connectors having a plurality of connect points, said connect points including a bore for engaging a member protruding in proximity to an end of one of said crossbars, sidebars, members, and posts, said engagement effecting a locking connection.

5. The apparatus as defined in claim 4 wherein said sleeve members further include a pair of bores, a first bore for engaging a member generally protruding proximately from an end of a first section and a second bore for engaging a member generally protruding proximately from an end of a second section, said bores being spaced so that when said bores engage said protruding members, said first and second sections substantially abut.

6. The apparatus as defined in claim 5 further comprising a pair of front support braces defining left and right front support braces, said left front support brace being joined to said left front post and said left lower sidebar, and said right front support brace being joined to said right front post and said right lower sidebar.

7. The apparatus as defined in claim 6 further comprising a pair of side support braces defining left and right side support braces, said left side support brace being joined to said left back post and said lower horizontal crossbar, and said right side support brace being joined to said right front post and said lower horizontal crossbar.

8. The apparatus as defined in claim 7 further comprising a net overlaying said portable goal, said net being attached thereto by straps affixed to said sports goal.

9. The apparatus as defined in claim 7 further comprising a net overlaying the goal, the net being attached thereto by straps affixed to the sports goal.

10. A portable goal comprising:

a pair of front posts defining a left front post and a right front post, the front posts having a plurality of sections, joined by a sleeve member;

a pair of back posts defining a left back post and a right back post, the left front post and the left back post being joined by a left lower sidebar, and the right front post and the right back post being joined by a right lower sidebar;

a pair of diagonal members defining a left diagonal member and a right diagonal member, the left diagonal member being coupled to the left back post and the right diagonal member being coupled to the right back post;

a pair of upper sidebars defining a left upper sidebar and a right upper sidebar, the left upper sidebar coupled to the left diagonal back post, and the right upper sidebar coupled to the right diagonal back post;

a pair of horizontal crossbars having a plurality of sections, each of the sections substantially aligned and joined by a sleeve member, and defining upper and lower horizontal crossbars, the lower horizontal crossbar joined at a first end to the left lower sidebar and the left back post and joined at a second end to the right lower sidebar and the right back post, the upper horizontal crossbar joined at a first end to the left upper sidebar and the left front post and at a second end to a second end of the right upper sidebar and the right front post; and a plurality of elbow connections for joining one of the crossbars, sidebars, members, and posts to another of the crossbar, sidebars, members, and posts, the elbow connections having a plurality of connect points, the connect points including a bore for engaging a member protruding in proximity to an end of one of the crossbars, sidebars, members, and posts, the engagement effecting a locking connection.

11. The apparatus as defined in claim 10 wherein the sleeve members further include a pair of bores, a first bore for engaging a member generally protruding proximately from an end of a first section and a second bore for engaging a member generally protruding proximately from an end of second section, the bores being spaced so that when the bores engage the protruding members, the first and second sections substantially abut.

12. The apparatus as defined in claim 10 further comprising a pair of front support braces defining left and right front support braces, the left front support brace being joined to the left front post and the left lower sidebar, and the right front support brace being joined to the right front post and the right lower sidebar.

13. The apparatus as defined in claim 10 further comprising a pair of side support braces defining left and right side support braces, the left side support brace being joined to the left back post and the lower horizontal crossbar, and the right side support brace being joined to the right front post and the lower horizontal crossbar.

* * * * *